United States Patent [19]

Faben

[11] 3,988,552

[45] Oct. 26, 1976

[54] EXTERNAL ADJUSTMENT SYSTEM FOR DISTRIBUTOR POINTS

[75] Inventor: Michael Faben, Woodland Hills, Calif.

[73] Assignee: Kenneth Herschman, Los Angeles, Calif.

[22] Filed: July 11, 1975

[21] Appl. No.: 595,123

[52] U.S. Cl. ..... 200/31 A; 200/249

[51] Int. Cl.[2] ..... H01H 1/24; H01H 19/62

[58] Field of Search ..... 200/19 R, 19 A, 21, 200/30 R, 30 A, 31 R, 31 A, 31 CA, 31 DP, 31 V, 286, 249, 19, 30, 31, 284

[56] References Cited

UNITED STATES PATENTS

| | | | |
|---|---|---|---|
| 2,594,447 | 4/1952 | Kerr | 200/31 A |
| 2,640,891 | 6/1953 | Buck et al. | 200/30 R |
| 2,797,269 | 6/1957 | Buck et al. | 200/286 X |
| 2,820,858 | 1/1958 | Tompkins | 200/31 A |
| 2,835,755 | 5/1958 | Filko | 200/31 A X |
| 2,914,625 | 11/1959 | Heveran | 200/31 A |
| 3,242,274 | 3/1966 | Sanden | 200/31 A UX |
| 3,350,517 | 10/1967 | Soeters | 200/31 A |
| 3,444,339 | 5/1969 | Jukes | 200/31 A X |
| 3,510,609 | 5/1970 | Cooksey | 200/31 A X |
| 3,581,025 | 5/1971 | Yeo et al. | 200/249 X |

*Primary Examiner*—James R. Scott
*Attorney, Agent, or Firm*—Clarence A. O'Brien; Harvey B. Jacobson

[57] ABSTRACT

An adjustment system incorporated into the distributor of an internal combustion engine for manually adjusting the points of the distributor from the exterior thereof thereby enabling the points to be adjusted while the engine is operating. The adjustment mechanism involves the use of a stationary bracket mounted on the conventional mounting screw for the distributor point mounting plate and a movable bracket engaged with the distributor contact point mounted stationarily on the mounting plate for adjusting the distributor point and associated portion of the mounting plate and a screw threaded member being located and journaled on the stationary bracket connected to the mounting screw and in screw threaded engagement with the movable bracket for varying the position of the distributor points.

10 Claims, 6 Drawing Figures

EXTERNAL ADJUSTMENT SYSTEM FOR DISTRIBUTOR POINTS

BACKGROUND OF THE INVENTION

1. Field of the Invention

The present invention generally relates to an external adjustment system for distributor points to enable the position of the distributor points to be accurately adjusted while the engine is operating and, more particularly, such a system which does not alter normal operation of the distributor and involves minimum alteration of existing structure.

2. Description of the Prior Art

Many structures have been provided for enabling adjustment of distributor points for enabling the gap and dwell to be adjusted for maximum efficiency of engine operation. Conventionally, adjustment is obtained by first loosening the mounting screw which attaches the slotted end of the distributor point assembly or sub breaker plate to the distributor breaker plate thus enabling adjustment of the stationary contact point thereby varying its relationship to the movable contact point. Such loosening and retightening of the mounting screw after adjustment of the contact points introduces substantial inaccuracies and also requires a trial and error adjustment. It has been recognized that adjustment of the distributor points while the engine is running obtains optimum adjustment of the contact points. The following U.S. patents illustrate developments in the manner of adjusting the contact points in a distributor:

U.S. Pat. Nos. 2,048,860 — July 28, 1936; 2,594,447 — Apr. 29, 1952; 2,640,891 — June 2, 1953; 2,727,104 — Dec. 13, 1955; 2,797,269 — June 25, 1957; 2,820,858 — Jan. 21, 1958; 2,835,755 — May 20, 1958; 3,242,274 — Mar. 22, 1966; 3,581,025 — May 25, 1971; 3,817,234 — June 18, 1974.

SUMMARY OF THE INVENTION

An object of the present invention is to provide an external adjustment system for distributor points which does not interfere with the movement of the breaker plates by the vacuum responsive advance or retarding mechanism with the adjustment mechanism being completely enclosed within the distributor housing during operation of the distributor but being accessible from externally of the housing when adjustment is desired, with the distributor cap remaining in place.

Another object of the invention is to provide an external adjustment system for distributor points in which the adjustment mechanism includes a bracket movably adjustably retained in position by the mounting screw for the distributor point contact assembly and a stationary bracket mounted on the same screw and a screw threaded connection between the stationary bracket and movable bracket to vary the position of the movable bracket in which the movable bracket includes a connection with the stationary contact point supporting structure for adjusting the position of the stationary contact point with respect to the cam operated movable contact point.

A further object of the present invention is to provide an adjustment system for distributor points in accordance with the preceding objects in which the screw threaded connection between the stationary bracket and movable bracket includes a screw threaded member journaled on the stationary bracket in a manner to prevent longitudinal movement and screw threaded into the movable bracket together with manually operated means associated with the screw threaded member for manipulation thereof.

Still another object of the invention is to provide an adjustment system in accordance with the preceding objects in which the means for manipulating the screw threaded member is oriented internally of the distributor housing and includes an opening in the distributor housing provided with a closure member which provides access to the screw threaded member either by using a manually manipulated tool or by extending the effective length of the screw thereaded member for projecting one end thereof through an opening in the housing so that the screw threaded member can be manipulated.

Still another important object of the present invention is to provide a distributor point adjustment system which can be manipulated externally of the distributor while the associated internal combustion engine is operative for enabling accurate adjustment of the distributor points with the structure being capable of installation in various presently employed distributor housings with minimum modifications of existing structures.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
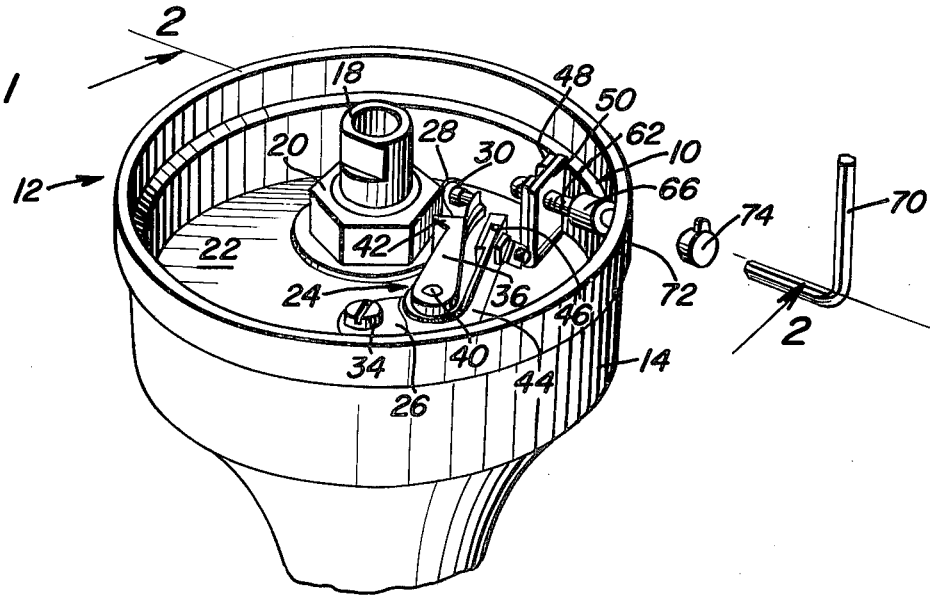
FIG. 1 is a perspective schematic view showing a portion of a distributor illustrating the external adjustment system of the present invention incorporated herein.
Figure 2:
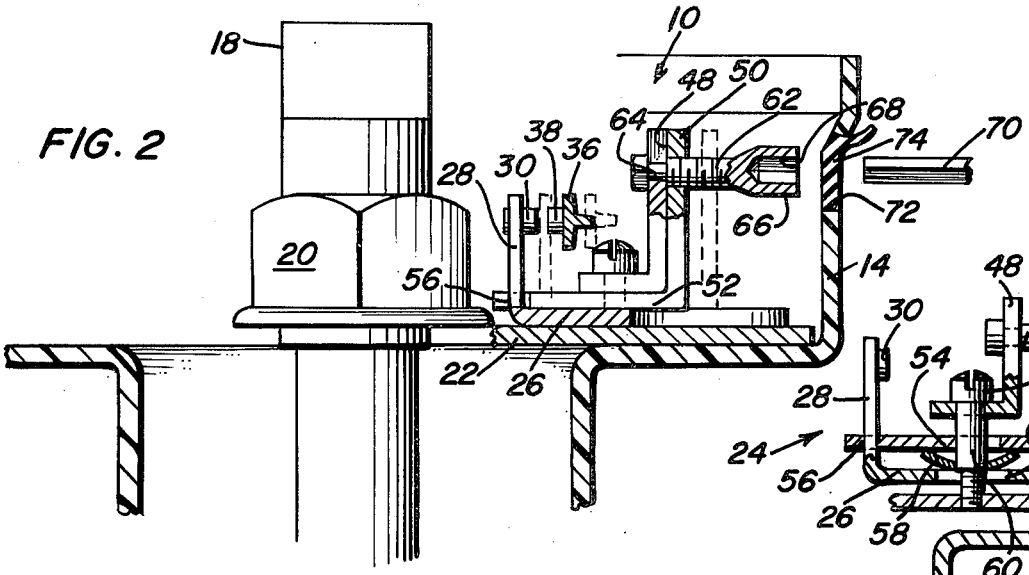
FIG. 2 is a vertical, sectional view, taken substantially upon a plane passing along section line 2—2 of FIG. 1, illustrating the specific structural details of one embodiment of the invention.
Figure 3:
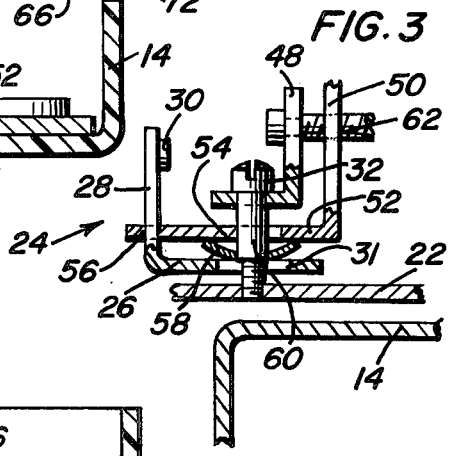
FIG. 3 is an exploded sectional view of the assembly of FIG. 2 illustrating the relationship of the structural components.
Figure 5:
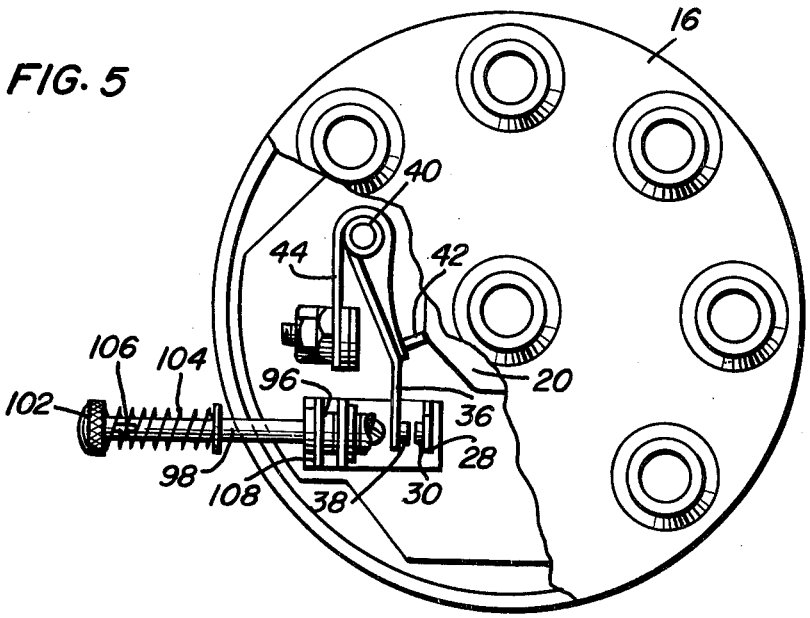
FIG. 5 is a plan view of a distributor with a portion of the distributor cap broken away illustrating the structure of another embodiment of the invention.

Referring now specifically to the drawings, the external adjustment system illustrated in FIGS. 1–3 is generally designated by numeral 10 and is installed in a conventional distributor assembly generally designated by the numeral 12 and which includes a distributor housing or base 14 having a removable cap 16 thereon as illustrated in FIG. 5. Only the essential interior components of the distributor are illustrated in the drawings and this includes the distributor shaft 18 having a cam 20 fixed thereon and rotatable therewith with the shaft 18 extending upwardly through a breaker plate 22 in a conventional manner. The breaker plate 22 may be moved in an angular direction about the shaft 18 by a vacuum responsive mechanism (not shown) and the shaft 18 includes a rotor on the upper end thereof (not shown) and other structural components of the distributor conventionally employed in internal combustion engines used in automobiles, trucks, and the like, are not shown since the essential elements of the invention reside in the external adjustment system 10 which is associated with the contact point assembly generally designed by numeral 24.

The assembly 24 includes a conventional sub breaker plate or mounting plate 26 having a stationary contact point arm 28 upstanding from one end edge thereof provided with a stationary contact point 30 thereon with the plate 26 at this end of the assembly including a slot 31 receiving a mounting screw 32 which enables adjustment of the contact point 30 inwardly and outwardly in relation to the cam 20 when the mounting screw 32 is loosened. The other end of the sub breaker plate 26 is anchored to the breaker plate 22 by a mounting screw 34. Also, mounted on the sub breaker plate 26 is a cam operated arm 36 having a movable contact point 38 on the free end thereof and the other end being pivotally mounted on an upstanding pin 40. The arm 36 includes a cam follower or rub plate 42 thereon which is retained in contact with the cam 20 by a leaf spring 44 which coils around the pin 40 and has one end anchored to the arm 36 and the other end anchored to an anchor member 46 on the sub breaker plate 26. The aforementioned structure represents conventional contact point struture with the points being adjusted by loosening the mounting screw 32, adjusting the contact point 30 to a desired position and then retightening the screw 32 which requires that the engine be inoperative when the points are adjusted and usually requires substantial trial and error adjustment of the points prior to reaching an optimum operating condition.

The external adjustment system 10 of the present invention includes a substantially L-shaped stationary bracket 48 having the upstanding leg thereof generally paralleling the peripheral wall of the distributing housing 14 and the horizontal leg disposed on the mounting screw 32 so that the bracket 48 is immovably connected to the mounting screw 32 and the breaker plate 22. Disposed alongside of the stationary bracket in an underlying relation thereto is an L-shaped movable bracket 50 which has its vertical leg disposed in parallel relation to the housing 14 and alongside the vertical leg of the bracket 48. The movable bracket 50 has an elongated horizontal leg 52 which has a slot 54 therein receiving the screw 32 so that the movable bracket 50 may be moved toward and away from the stationary bracket 48. The end of the horizontal leg 52 of the movable bracket 50 is provided with a laterally opening notch 56 therein which straddles and receives the upstanding arm 28 on the sub breaker plate 26 so that movement of the movable bracket 50 will cause movement of the arm 28 and corresponding movement of the contact point 30. A spring washer 58 on the mounting screw 32 and interposed between the movable bracket horizontal leg 52 and the sub breaker plate 26 will frictionally maintain these components in adjusted position when the mounting screw 32 is tightened downwardly to the extent permitted by a bushing 60 mounted thereon with the bushing extending between the breaker plate 22 and the head of the screw to limit the tightening engagement of the screw 32. The tightening of the screw 32 combined with the spring washer 58 provides sufficient frictional contact between the components to retain them in adjusted position although the frictional retention may be overcome by movement of the movable bracket 50 which, in turn, will cause movement of the arm 28 and the contact point 30 thereon.

The movable bracket 50 is engaged by a screw threaded actuating member 62 which extends through and is screw threaded with the vertical leg thereof. The screw threaded member 62 has a reduced portion or annular groove 64 formed therein which journals the screw threaded member on the stationary bracket 48 so that the screw threaded member 62 may rotate in relation to the stationary bracket 48 but cannot move longitudinally in relation thereto and the screw threaded member 62 being threaded through the movable bracket 50 will cause movement of the bracket 50 toward and away from the stationary bracket 48 when the screw threaded member is rotated with such movement being within the limits defined by the slot 54 formed in the horizontal leg 52 of the bracket 50. The end of the screw threaded member 62 opposite from the grooved portion 64 is provided with an enlarged head 66 having a socket 68 formed therein of polygonal configuration for receiving the polygonal end of a conventional wrench 70 such as an Allen wrench. The head 66 of the screw threaded member 62 is disposed interiorly of the distributing housing which is provided with an opening 72 therein through which the wrench 70 may be inserted for adjusting the screw threaded member 62. The opening 72 is provided with a closure member 74 which may be in a form of a resilient plug or the like that will be frictionally retained in position or it may be a screw threaded member or any other suitable closure plug which can be removed to enable access to the interior of the housing 14 and enable the wrench 70 to be engaged in the socket 68 for rotation of the screw threaded member 62 for moving of the movable bracket 50 and the contact point 30 while the engine with which the distributor is associated remains operative thereby enabling optimum adjustment of the contact point 30 for maximum efficiency of the engine.

Figure 4:
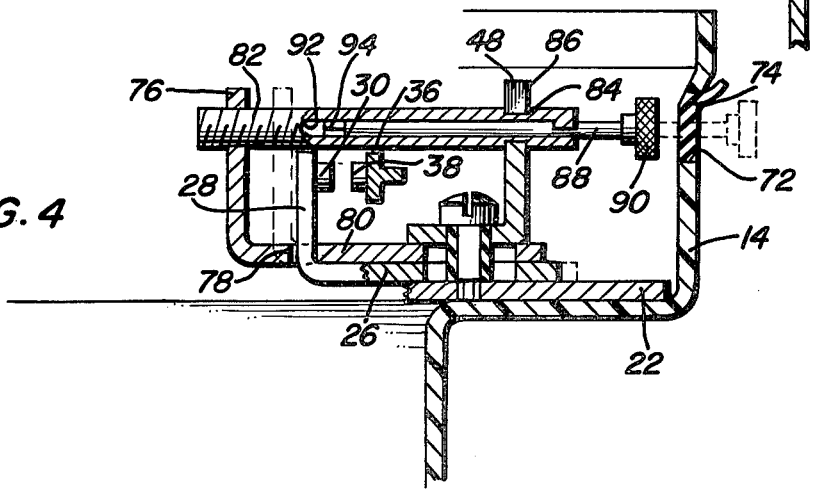
FIG. 4 is a sectional view similar to FIG. 2 but illustrating another embodiment of the invention.

FIG. 4 illustrates a variation in the structure in which the components of the distributor remain the same as in FIGS. 1–3 and the stationary bracket 48 remains the same. One difference in this construction is the movable bracket 76 extending remotely from the stationary bracket 48 rather than adjacent thereto as does the movable bracket 50 in FIGS. 1–3. In this embodiment, the movable bracket 76 includes a notch 78 in the horizontal leg 80 thereof which receives the upstanding arm 28 so that the side edge of the notch 78 may be positioned laterally into engagement with the arm 28. The upper end portion of the movable bracket 78 receives an elongated screw threaded member 82 which is screw threaded therethrough and which is provided with a groove 84 journaled in the stationary bracket 48. The groove 84, as is the groove 64 in FIGS. 1–3, may be received in a vertically opening notch 86 in the upper end of the stationary bracket 48 or the screw threaded member may be rotatably secured thereto in any suitable manner so that the screw threaded member 82 will not move longitudinally in relation to the stationary bracket 48. This arrangement of components enables assembly of the external adjustment system with a distributor having a different size and type of distributor housing thus providing for universal incorporation of the invention into various types of distributor arrangements.

In the construction of FIG. 4, the screw threaded member 82 is provided with a longitudinally telescopic operating rod 88 having a knurled knob 90 thereon which can be extended through the opening 72 in the distributing housing 22, when the closure member 74 has been removed, into the dotted line position illustrated in FIG. 4 for rotative manipulation of the knob 90 from a position externally of the housing 14. The rod 88 is telescoped into an internal bore 92 in the screw threaded member 82. The inner end of the rod 88 is provided with a polygonal portion 94 which engages with a correspondingly shaped portion of the bore 92. The entire length of the bore 92 and the rod 88 may be polygonal if desired or the inner end of the rod 88 may be provided with a laterally extending tongue or tab slidably received in a groove formed in the interior of the bore 92, so that a rotational driving connection is provided between the rod 88 and the screw threaded member 82 for rotation of the screw threaded member 82 when the knob is rotated. Rotation of the screw threaded member 82 will cause the movable bracket 76 to move the sub breaker plate 26, the arm 28 and the contact point 30 thereon in relation to the movable contact point 38 for varying the gap and dwell of the points.

Figure 6:
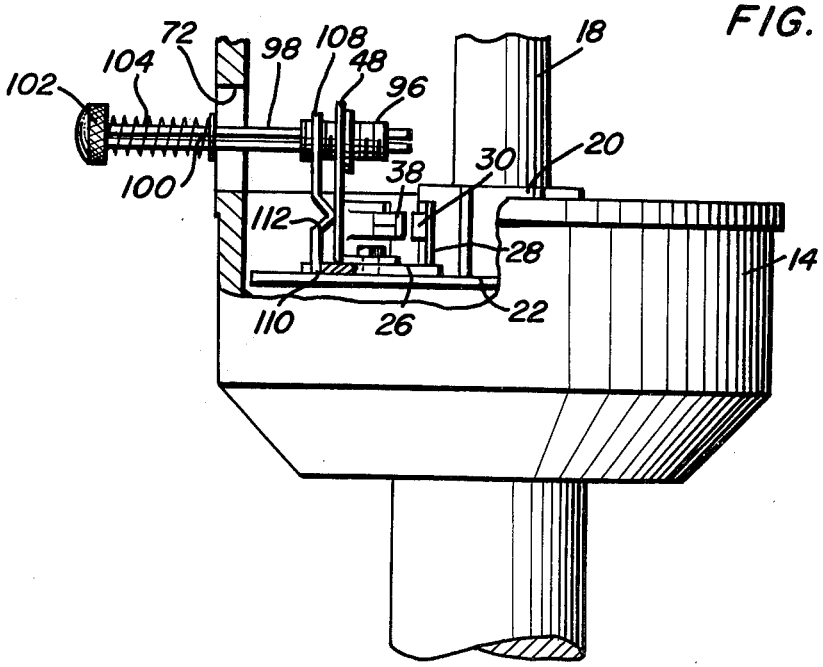
FIG. 6 is a longitudinal, sectional view of the construction of FIG. 5.

The structure in FIGS. 5 and 6 performs generally in the same manner as that illustrated in FIGS. 1–4 and the same reference numerals are employed for the same components with the stationary bracket 48 being the same as that illustrated in FIGS. 1–4. In this embodiment of the invention, a tubular screw threaded member 96 is journaled in the upper end of the stationary bracket 48 and includes an operating rod 98 slidable therethrough with the rod 98 having a longitudinal groove 100 therein receiving an internal projection in the threaded member 96. One end of the rod 98 is provided with a knurled knob 102 and a spring 104 is positioned against the knob 102 for biasing the rod outwardly when it has been moved completely inwardly of the distributor housing. A lateral groove 106 adjacent the knob 102 is in communication with the longitudinal groove 102 to receive the projection in the interior of the threaded member 96 when the rod 98 is moved all the way inwardly and rotated a partial turn thus locking the rod 98 in its retracted or stored position completely within the interior of the distributor housing. When it is desired to use the rod 98 to adjust the point 30, the knob 102 is rotated a partial turn and the spring 104, being under compression, will move the rod 98 outwardly of the threaded member 96 so that the knob 102 is accessible externally of the distributor housing. Rotation of rod 98 will rotate the screw threaded member 96 which is screw threaded through a movable bracket 108 connected to the sub breaker plate 26' by virtue of the lower end of the bracket 108 being connected with the sub breaker plate 26' by providing an aperture or recess 110 receiving the lower end of the movable bracket 108 with the movable bracket 108 being attached to the sub breaker plate 26' in any suitable manner. The central portion of teh movable bracket 108 is provided with an offset 112 which limits the movement of the breaker point 30 away from the breaker point 38. In this embodiment, as well as in the others, rotational movement of the knob 102 from a point externally of the distributor housing will adjust the position of the stationary contact point 30, thus varying the gap between the points and the dwell characteristics of the points.

The conventional anchoring screw 34 may be replaced with a screw having a tubular bushing and washer thereon to facilitate pivotal movement of plate 26 about the screw. When installing the adjustment system of this invention, no change in the original distributor design is required. Presently available adjustment systems require modification of the distributor design in order to permit installation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an ignition distributor in the fuel ignition system of an internal combustion engine of the type having a housing, a cam operated contact point and an adjustable contact point, said adjustable contact point being provided with a slotted mounting plate and mounting screw extending therethrough to selectively lock the adjustable contact point in adjusted position whereby the gap and dwell characteristics of the points may be varied by adjusting the adjustable contact point in relation to the cam operated contact point, that improvement comprising actuating means operatively associated with the mounting screw and adjustable contact point to enable adjustment of the adjustable contact point without manipulation of the mounting screw, said actuating means including manually operable means accessible from the exterior of the distributor housing to enable adjustment of the adjustable contact point while the engine is operative, said manually operable means including a stationary bracket mounted on said mounting screw, a movable bracket mounted on said mounting screw alongside the stationary bracket, a rotatable screw threaded member interconnecting the stationary bracket and movable bracket for moving the movable bracket in relation to the stationary bracket, and means releaseably connecting the movable bracket to the adjustable contact point for moving the contact point therewith.

2. The structure as defined in claim 1, wherein said screw threaded member has a head at one end thereof oriented internally of the distributor housing, said head including a wrench receiving means thereon, said distributor housing having an opening therein provided with a closure member by which a wrench may be inserted through the opening into engagement with the head of the screw threaded member for rotation of the same while the distributor cap remains in place and while the engine remains operative.

3. The structure as defined in claim 1, wherein said screw threaded member includes an internal bore, a rod slidable within said internal bore, a knob on the end of the rod, said housing having an opening therein to enable passage of the knob from the interior to the exterior of the distributor housing to enable manual manipulation of the screw threaded member from a point externally of the housing, and a closure member for the opening in the housing.

4. The structure as defined in claim 3, together with a spring interconnecting the rod and screw threaded member for biasing the rod outwardly to a position where the knob is disposed externally of the housing.

5. The structure as defined in claim 1, wherein said stationary bracket and movable bracket are of substantially L-shaped configuration including a substantially horizontal leg and a substantially vertical leg with the screw threaded member interconnecting the upper end portions of the vertical leg of the stationary bracket and the vertical leg of the movable bracket, the horizontal leg of the stationary bracket including an opening receiving the mounting screw and the horizontal leg of the movable bracket having a slot therein receiving the mounting screw, said mounting screw including a bushing extending through the stationary bracket and a slot in the movable bracket and slotted mounting plate of the adjustable contact point to limit the clamping action of the mounting screw to enable movement of the movable bracket and the adjustable contact point in relation to the mounting screw while maintaining the stationary bracket in fixed relation.

6. The structure as defined in claimd 5, wherein said means releasably connecting the movable bracket to the adjustable contact point includes a laterally extending notch in the free end portion of the horizontal leg of the movable bracket with the notch receiving the adjustable contact point to enable connection of the movable bracket with the adjustable contact point by laterally moving the horizontal leg of the movable bracket into engagement therewith.

7. The structure as defined in claim 6, together with a resilient device mounted between the horizontal leg of the movable bracket and the mounting plate of the adjustable contact point for frictionally maintaining the movable bracket and adjustable contact point in adjusted position.

8. The structure as defined in claim 7, wherein said rotatable screw threaded member includes a groove in the periphery of the end portion thereof rotatably received in an opening through the upper end portion of the vertical leg of the stationary bracket, said screw threaded member being screw threaded through the upper end portion of the vertical leg of the movable bracket for moving the vertical legs toward and away from each other during rotation of the screw threaded member.

9. The structure as defined in claim 1, wherein said stationary bracket and movable bracket are each substantially L-shaped and include horizontally disposed legs in contact with each other and upwardly extending legs in spaced, generally parallel relationship to each other, with the vertical leg of the stationary bracket being to one side of the adjustable contact point and the vertical leg of the movable bracket being to the opposite side of the adjustable contact point, the horizontal leg of the movable bracket including a slot receiving the mounting screw adjacent an end portion thereof and the horizontal leg of the movable bracket including a notch adjacent the vertical leg receiving the adjustable contact point, said screw threaded member extending between the upper end portions of the vertical legs of the stationary bracket and movable bracket and being screw threaded through the vertical leg of the movable bracket and rotatably but non-longitudinally movably connected to the upper end portion of the vertical leg of the stationary bracket, said tubular member including a longitudinal bore communicating with the end thereof extending through the stationary bracket, a rod longitudinally slidable in said bore and drivingly connected to the screw threaded member, said rod having a knob on the end thereof outwardly of the screw threaded member, said housing of the distributor having an opening therein aligned with the knob to enable the rod and knob to be moved longitudinally outwardly until the knob assumes a position outwardly of the housing for manipulation of the rod and screw threaded member thereby moving the movable contact point from a point externally of the housing, and a closure member for the opening in the housing.

10. An add-on adjustor for the adjustable contact point of a distributor in which the mounting and locking screw normally provided through the slotted mounting plate for the adjustable contact point is removed and the adjustor positioned in engagement with the upstanding leg of the adjustable contact point and the mounting screw reinserted thereby enabling assembly of the adjustor into the distributor without modification of the distributor, said adjustor comprising a pair of generally L-shaped brackets with the brackets being disposed in overlying relation to each other with the uppermost bracket being stationary and including an opening in the horizontal leg thereof closely receiving the mounting screw, the horizontal leg of the movable bracket including a slot therein adjustably received on the mounting screw, the horizontal leg of the movable bracket also including a laterally opening notch receiving the upstanding leg of the adjustable contact point for connecting the movable bracket with the adjustable contact point for movement of the adjustable contact point with the movable bracket, and screw threaded means interconnecting the upper end portions of the vertical legs of the stationary bracket and movable bracket for moving the movable bracket in relation to the stationary bracket and moving the adjustable contact point in relation to the cam operated point of the distributor upon rotation of the screw threaded member.

* * * * *